United States Patent [19]

Ito

[11] 3,972,306

[45] Aug. 3, 1976

[54] COIL SHAPED DEVELOPING ELECTRODE FOR A COPYING MACHINE

[75] Inventor: Fukusaburo Ito, Yamatokoriyama, Japan

[73] Assignee: Sharp Kabushiki Kaisha, Osaka, Japan

[22] Filed: Oct. 4, 1974

[21] Appl. No.: 512,292

[30] Foreign Application Priority Data

Oct. 5, 1973 Japan ..... 48-112501

[52] U.S. Cl. ..... 118/637; 118/DIG. 23; 204/280; 204/290 F

[51] Int. Cl.[2] ..... G03G 15/10

[58] Field of Search ..... 118/637, DIG. 23; 355/3 P, 10; 96/1 LY; 204/280, 290 F, 290 R; 117/37 LE

[56] References Cited

UNITED STATES PATENTS

| | | | |
|---|---|---|---|
| 2,795,541 | 6/1957 | Muller | 204/290 F |
| 2,929,769 | 3/1960 | Newell et al. | 204/290 F |
| 3,297,560 | 1/1967 | Schleicher | 204/290 F |
| 3,409,530 | 11/1968 | Locke et al. | 204/280 |
| 3,753,393 | 8/1973 | Niesen et al. | 118/DIG. 23 |
| 3,799,791 | 3/1975 | Kolibas | 118/637 |

*Primary Examiner*—Mervin Stein
*Assistant Examiner*—Douglas Salser
*Attorney, Agent, or Firm*—Stewart and Kolasch, Ltd.

[57] ABSTRACT

A copying machine which produces one or more copied sheets by utilizing an electronic photographic method, wherein a coil shaped developing electrode is provided close to the traveling path of the photosensitive paper or the surface of the dram within the developing section of the device. Electric lines of force caused by an electrostatic latent image formed on the photosensitive paper or the dram are uniformly intensified as the paper or the dram pass near the developing electrode, whereby the edge development effects are suppressed and the contrast of the developing image is amplified in order to obtain a clean copy. A developer is replenished onto the photosensitive paper or the surface of the dram through clearances provided within the coil shaped developing electrode.

5 Claims, 3 Drawing Figures

COIL SHAPED DEVELOPING ELECTRODE FOR A COPYING MACHINE

BACKGROUND OF THE INVENTION

The present invention relates to a developing electrode for use in developing an electrostatic latent image.

The electrostatic latent image is usually formed by utilizing an electronic photographic method or by applying pulses of high voltage level to a stylus electrode provided adjacent to the surface of a dielectric layer.

Various kinds of methods for developing electrostatic latent images are well known in the art, such as for example, the cascade method, the magnetic brush method, the powder cloud method and the liquid developer method.

Recently, the developing electrode has become practical in the developing methods set forth above in order to obtain a clean copy.

The electrostatic latent image is formed on a photoconductive insulator mounted on a conductive substrate or the image is formed on a surface of a dielectric layer. When the image has a large area, voltage contrast at the central area of the latent image becomes lower as compared to the peripheral area of the image, since the peripheral area has the boundary area between a charged area and an uncharged area but the central area of the image does not have such a boundary area. Therefore, an electric field is formed inward of the photo-conductive insulator or the dielectric layer but the electric lines of force are only slightly at the outside near the central area of the image. When the development operation is carried out under these conditions, a large amount of the developer is deposited onto the peripheral area but the developer is only scarcely deposited onto the central area of the image. This effect is referred to as the edge development effects, which is well known in the art.

The electric lines of force created from the central area of the latent image may be changed by installing a developing electrode made of conductive material such as metal in a manner so as to adjoin the latent image, thereby intensifying the electric field formed between the developing electrode and the latent image. The electric field is greatly intensified as the distance between the developing electrode and the latent image is made shorter.

The developing electrode must be provided close to the path of the photosensitive paper or the surface of the dram in the developing section, but the electrode must be installed in a manner not to disturb the replenishment of the developer including toner at a proper concentration onto the surface of the photosensitive paper or the dram. The developing electrode of the prior art tended to disturb the replenishment of the developer onto the surface of the photosensitive paper or the dram when the developing electrode is disposed close to the path of the photosensitive paper or the surface of the dram, since the developing electrode of the prior art is made of a metal plate of a flat configuration or a curved configuration. Therefore, the developing electrode of the prior art must be disposed in a manner so as to provide an appropriate distance between the developing electrode and the surface of the photosensitive paper or the dram. However, when the distance between the developing electrode and the surface of the photosensitve paper or the dram is increased, the electric field intensifying effect may be weaken. There has been some suggested solutions such as to make the developing electrode of a material in order to eliminate the above-mentioned defects. When a mesh electrode is used for the developing electrode, the replenishment of the developer may be smoothly accomplished, but the mesh electrode can not be positioned close to the path of the photosensitive paper or the surface of the dram at all times, since the mesh is so soft.

OBJECTS AND SUMMARY OF THE INVENTION

Accordingly, an object of the present invention is to provide a copying machine which ensures a clean copy.

Another object of the present invention is to provide a developing electrode suited for making a clean copy.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objectives, the developing unit of the copying machine of the present invention is provided with a coil shaped developing electrode. The coil electrode may have good contact with the surface of the photosensitive paper or dram as they pass through the developing unit. The developer may be replenished onto the surface of the photosensitive paper or the dram through clearances provided within the coil shaped developing electrode. By employing the coil shaped electrode, a edge development effects are suppressed even though the image has a large area. Moreover, reproducibility of continuous gradation is improved, and the contrast of the image is intensified.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
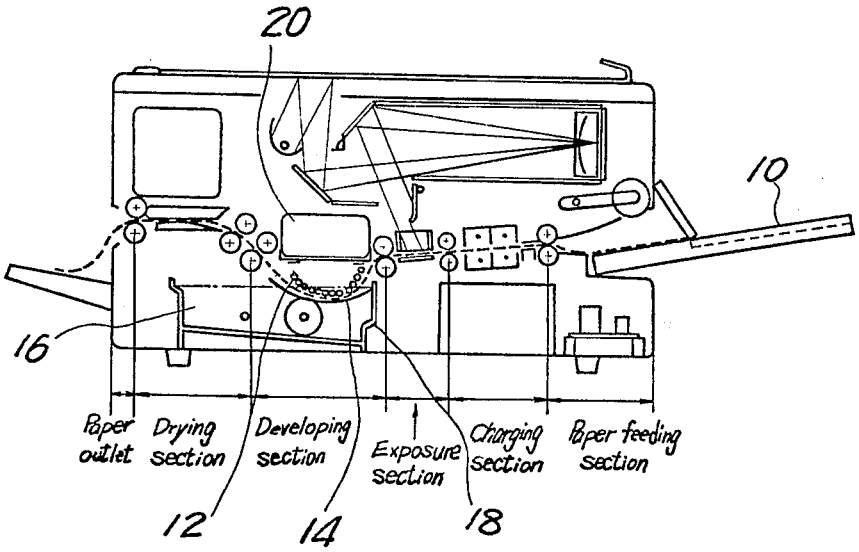
FIG. 1 is a sectional view of a copying machine embodying the present invention.

Referring now in detail to the drawings, and to facilitate a more complete understanding of the present invention, a copying machine employing a coil shaped developing electrode of the present invention will be first described with reference to FIG. 1.

In this embodiment, the liquid developer method is employed for developing an electrostatic latent image. Photosensitive paper is fed from a cassette 10, which holds sheets of the photosensitive paper therein, and the photosensitive paper passes through a paper feeding section, a charging section, an exposure section, a developing section and a drying section and the copied sheet is discharged from a paper outlet, as is well known in the art. There is provided a coil shaped developing electrode 12 within the developing section. The photosensitive paper, which carries an electrostatic latent image thereon, is fed along clearance provided between the coil shaped developing electrode 12 and a paper feeding guide 14 in the developing section. The photosensitive paper may be dipped in developing liquid 16 contained within a developing tank 18 as the paper passes along clearance provided between the coil shaped electrode 12 and the paper feeding guide 14. The developer may be replenished by a sub tank cartridge 20 onto the photosensitive paper in order to make a clean copy.

Figure 2:
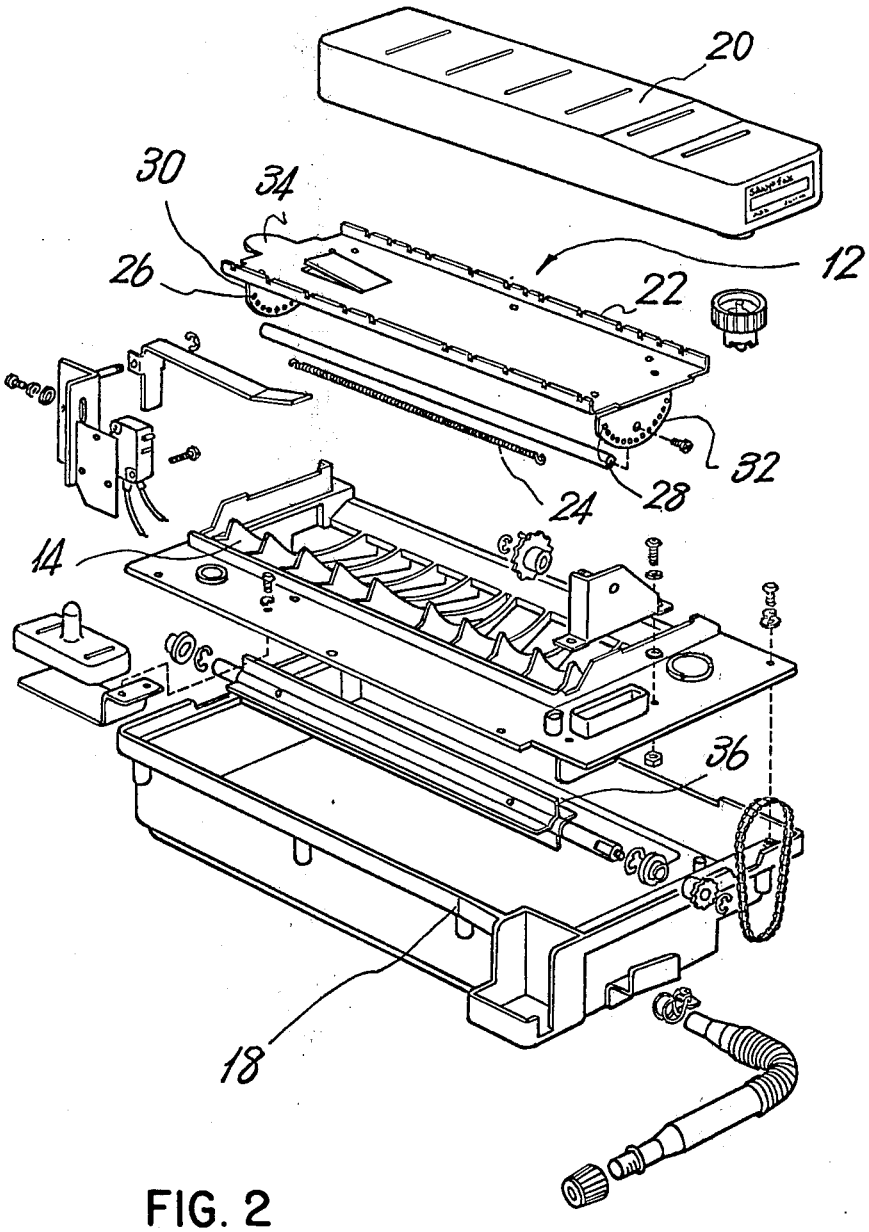
FIG. 2 is an exploded perspective view of a developing unit embodying the present invention.

Referring now to FIG. 2, there is illustrated the construction of the developing unit of the present invention including a coil shaped developing electrode 12. Like elements corresponding to those of FIG. 1 are indicated by like numerals.

The coil shaped developing electrode 12 mainly comprises a supporting plate 22 made of metal and coil springs 24 made of metal. Both ends of the coil springs 24 are supported by metal pieces 30, 32 with the use of holes 26 and 28 provided on the metal pieces 30, 32, the metal pieces 30, 32 being connected to the supporting plate 22. The supporting plate 22 is connected with the chassis of the copying machine with the use of a projection 34 and hence the ground earth potential. Therefore, the coil springs 24 are supplied with the voltage of the earth potential level. Clearances are formed within the coil springs 24, since the springs 24 are supported by the metal pieces 30, 32 with the use of elasticity of the springs 24. A stirrer 36 is provided for stirring the developing liquid contained within a developing tank 18.

Figure 3:
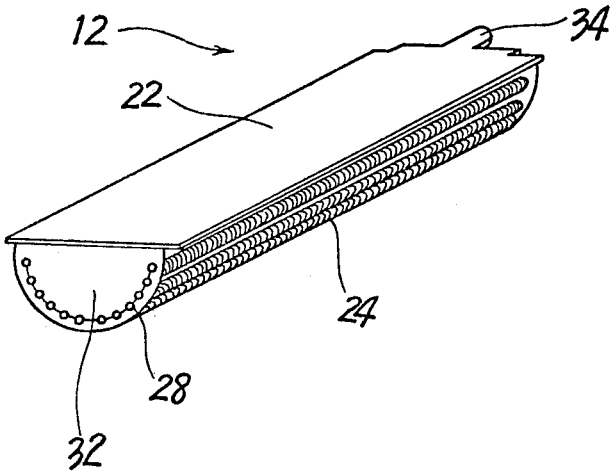
FIG. 3 is a perspective view of an embodiment of the coil shaped developing electrode of the present invention.

FIG. 3 is a perspective view of an embodiment of the coil shaped developing electrode 12 of the present invention.

There are provided twelve coil springs 24 between the metal pieces 30 and 32. The developer may move smoothly through the clearances formed within the coil springs 24 and between the adjacent coil springs 24.

The coil shaped developing electrode 12 of the present invention may be provided close to the electrostatic latent image formed on the surface of the photosensitive paper without disturbing the replenishment of the developer including toner at a proper concentration onto the surface of the electrostatic latent image, because the coil springs 24 are provided with clearances therein and also have an elastic nature. The electric field intensifying effect may be satisfactorily obtained and therefore the clean copy may be produced.

In the liquid developer method, the time period of the development operation is an important factor. It is necessary to dip the photosensitive paper in the developing liquid more than ten seconds in order to obtain the clean copy without use of the developing electrode. When the developing electrode of the present invention is provided within the developing section, the developing operation may be carried out in 0.5 – 2 seconds in order to obtain the clean copy.

The copying machine employing the coil shaped developing electrode of the present invention is also suited for obtaining a master paper for use in offset printing and making the secondary original for use in electrostatic photography, since the contrast of the developed image formed by the copying machine employing the coil shaped developing electrode of the present invention is very high.

The following is a table for the purpose of explanation of the effect of the present invention, wherein the image developed by the developing unit including the coil shaped developing electrode of the present invention is compared with the image developed by the developing unit including the metal plate developing electrode of the prior art.

| Original | | Blackness of copied image | |
|---|---|---|---|
| Diameter of a black flat circle (mm) | Blackness of the original | The plate developing electrode of the prior art is used | The coil shaped developing electrode of the present invention is used |
| 8 | 1.6 | 0.8 | 1.2 |
| 15 | 1.6 | 0.75 | 1.1 |
| 30 | 1.5 | 0.7 | 1.05 |

The detection is carried out at the center of the circle of the original and copied image with the use of the densitometer of the reflection type. Needless to say, other conditions of the development operation, such as the period of time for dipping the photosensitive paper into the developing liquid and the concentration of the developing liquid, were chosen identically in both operations for producing the copied image.

When the cascade method is carried out in order to develop the electrostatic latent image, the plate type developing electrode of the prior art can not work well. The carrier, which carries toner thereon, has a large diameter (0.3 –0.5 mm), and therefore, the plate electrode of the prior art must be spaced away from the surface of the dram about 3 mm in order not to disturb the smooth replenishment of the developer onto the surface of the dram.

Thus, the electric field intensifying effect is not sufficiently obtained. On the contrary, the coil shaped developing electrode of the present invention may be installed close to the surface of the dram, since the carrier, which carries toner thereon may be replenished onto the surface of the dram through the clearances provided within the coil springs or between the adjacent coil springs. The electric lines of force created by the electrostatic latent image may be intensified and a clean copy may be obtained even though the original has a large flat black area when the coil shaped developing electrode of the present invention is employed in the developing unit. For example, when the original is a flat black circle with a diameter of 15 mm and a blackness of 1.6, the obtained copy has a blackness of 1.2 when the coil shaped developing electrode of the present invention is used, and a blackness of 0.6 when the plate type developing electrode of the prior art is used.

The invention being thus described, it will be obvious that the same way be varied in many ways. Such variations are not to be regarded as a departure from the spirit and scope of the invention, and all such modifications are intended to be included within the scope of the following claims.

What is claimed is:

1. In a developing unit for an electrostatic copying machine which forms a developed image on a photosensitive paper by virtue of the sequential operations of charging, exposure and developing, the improvement which comprises:

a coil shaped resilient developing electrode provided in close proximity to the path of the traveling photosensitive paper within the developing unit.

2. The developing unit of claim 1, wherein a developing tank is provided for housing developing liquid therein; a sub-tank cartridge is provided for replenishing the developing liquid onto the photosensitive paper; and a paper feeding guide is provided; said coil shaped resilient developing electrode being disposed in close proximity to the paper feeding guide.

3. In a developing unit for an electrophotographic machine which forms a developed image on a drum through a xerographic process, the improvement comprising:

a coil shaped resilient developing electrode provided in close proximity to the surface of the drum within the developing unit.

4. In a developing unit for an electrostatic copying machine which forms a developed image on a photosensitive paper by virtue of the sequential operations of charging, exposure, and developing, the improvement which comprises a coiled shaped developing electrode provided in close proximity to the path of the traveling photosensitive paper within the developing unit, said coil shaped developing electrode comprising coil springs and a supporting metal plate for supporting said coil springs.

5. The developing unit of claim 4, wherein said coil springs are connected with the ground earth potential through the supporting metal plate.

* * * * *